US005228715A

United States Patent [19]

Sedlmair

[11] Patent Number: 5,228,715

[45] Date of Patent: Jul. 20, 1993

[54] SKI BINDING LOCKING DEVICE

[75] Inventor: Gerhard Sedlmair, Farchant, Fed. Rep. of Germany

[73] Assignee: Marker Deutschland GmbH, Fed. Rep. of Germany

[21] Appl. No.: 841,362

[22] Filed: Feb. 25, 1992

[30] Foreign Application Priority Data

Feb. 28, 1991 [DE] Fed. Rep. of Germany ..... 9102427

[51] Int. Cl.[5] ..... A63C 9/082

[52] U.S. Cl. ..... 280/620; 280/634; 280/626

[58] Field of Search ..... 280/623, 632, 634, 626, 280/620

[56] References Cited

U.S. PATENT DOCUMENTS

| | | | |
|---|---|---|---|
| 3,249,365 | 5/1966 | Beyl | 280/11.35 |
| 4,035,001 | 7/1977 | Jungkind | 280/626 |
| 4,140,332 | 2/1979 | Beyl | 280/626 |
| 4,405,153 | 9/1983 | Salomon | 280/634 X |
| 4,765,641 | 8/1988 | Peyre | 280/634 X |
| 4,813,719 | 3/1989 | Dimier | 280/618 |

FOREIGN PATENT DOCUMENTS

| | | | |
|---|---|---|---|
| 2248680 | 9/1973 | France . | |
| 250806 | 1/1983 | France | 280/623 |
| 51230 | 4/1977 | Japan | 280/623 |

*Primary Examiner*—David M. Mitchell
*Assistant Examiner*—Gary C. Hoge
*Attorney, Agent, or Firm*—D. Peter Hochberg; Mark Kusner

[57] ABSTRACT

A tightening device for the heel portion of a safety ski binding comprises a ski boot holding member which includes a sole holder and a closing pedal positioned between arms extending from upright shoulders connected to a turntable attachable to a ski. A support member with one of its ends pivotally attached to the bottom of the holding member has a hook on its free end, and when a ski on which the binding is mounted is to be transported, the support member can be pivoted from a holding member supporting position in which its free end rests on an upper surface associated with the ski, to a position in which the hook engages a projecting surface forming part of the turntable, or of a bearing surface associated therewith. The binding components are thus locked in a tightened position, eliminating movement therebetween. The device can be unlocked by rotating the turntable slightly in either direction, bringing the hook into contact with a disengaging ramp surface associated with the device, which lifts the hook free of the projecting surface, thereby allowing a torsion spring on the support member to move the support member back into a vertical holding member supporting position.

10 Claims, 5 Drawing Sheets

SKI BINDING LOCKING DEVICE

TECHNICAL FIELD

This invention relates to the tightening or locking of safety ski bindings. More particularly, this invention relates for tightening or "locking" the heel portion of safety ski bindings mounted on skis during the transportation thereof. Specifically, this invention relates to locking or tightening devices for the heel portion of safety ski bindings, which bindings are of the type equipped with a turntable connected to a pair of parallel, rigid arms having a sole holder and a closing pedal assembly positioned therebetween. In the binding of the invention, when the ski is ready for use but a ski boot is not yet fitted in the binding, such assembly is held by a pivotal support member in a raised position, spaced apart from the upper ski surface, thus facilitating the insertion of a boot in the binding. However, when the ski is not in use, as for example, during its transportation, the support member is pivoted into a locked position which prevents unwanted movement of the binding components that might otherwise occur.

BACKGROUND OF THE INVENTION

Tightening devices of the general type with which the invention is concerned comprise two, upstanding yoke-like shoulder members mounted on a turntable fastened to the upper surface of the ski. Pivotally connected to the shoulder members are two rigid arms, associated with a ski boot holding member comprising a sole holder and closing pedal assembly which is a supported between the arms. The holding member secures the heel of the ski boot in the binding, and is pivotal against the force of a trigger spring into an open, release position under conditions which makes release of the boot desirable. In its position of prospective use, the holding member is held spaced apart from the ski's upper surface by a support member attached to the lower part of the holding member and positionable between it and the ski, the support member bearing upon the top of the ski during times when a ski boot is not located in the binding.

Heel tightening devices of the type described have become popular for a variety of reasons, including the fact that rotation of the turntable assists in the emergency release of a boot from the binding, and such devices embody a number of design variations. In one design, for example, the rigid arms associated with the holding members are each loaded with a spring disposed thereon which bears against the turntable and helps to force the support member against the ski's upper surface, the objective being to provide a firm engagement therewith and thus avoid the objectionable movement or "play" associated with the transportation of skis on which such bindings are mounted.

Unfortunately, however, due to the presence of the required pivotable connections of the binding components, as well as the cumulative weight of the components attached to the shoulder members, the components tend to move about as the skis are carried, or when they are transported on an automobile. In the case of transportation on the roof of an automobile, for example, such movement can cause unintended and destructive imparts of the components with the automobile's roof. Even when skis with such bindings are simply being carried, however, the movement referred to can cause insecure and unpleasant sensations to the carrier thereof, all of which is undesirable.

In view of the foregoing therefore, it is an aspect of this invention to provide a ski binding of the type referred to in which the support member is made pivotal at its point of connection with the holding member, about an axis parallel to the pivot axis of the rigid arms. Furthermore, the free end of the support member is provided with a hook-like structure, adapted for engagement with a projecting surface which may form part of the turntable. This construction allows the support members of skis not in use to be pivoted toward such surface and the hook to be engaged therewith so that the rigid arms and the holding member associated with the support member are effectively restrained in an immobilized position.

In another aspect of the invention described, it is desirable that the support member be provided with spring means adapted to force the support member into a supporting position so as to avoid any unintended pivoting thereof.

A further aspect of the invention is to provide a tightening device of the type described in which when the sole holder and closing pedal assembly can be locked in an immobilized position. In this condition, it is impossible for the support member to be inadvertently deployed into its holding member-supporting position. Likewise, in the binding's locked position, it is not possible for the assembly to be moved into its "closed" position, i.e., where the sole holder and closing pedal are positioned to secure the heel of a ski boot within the binding, as opposed to the binding's "open" position, where the boot is not so held.

Another aspect of the invention assures that when the assembly is secured in its locked position, it can be released therefrom merely by rotating the turntable to which it is connected by a relatively small amount, e.g., desirably no more than about one-third of the total arc through which the turntable is ordinarily rotatable.

An additional aspect of the invention is to provide the projecting surface with which the hook of the support member is engagable, or equivalent structure, with an inclined ramp, or abutment, on each side thereof. With such a design, the hook can be readily released from the projecting surface merely by rotating the turntable in either direction, thereby causing the hook to ride upwardly on one of the ramps to an elevation at which it is no longer engaged with the projecting surface.

A still further aspect of the invention involves the provision of turntable centering means, for example, springs which cooperate with the turntable in order to return the latter to its original position following its displacement therefrom, as for instance, in the hook-disengaging process.

Yet another aspect of this invention in those embodiments which include a bearing plate for the turntable, comprises the provision of a radial lug extending from the plate which serves as a bearing surface for the free end of the support member. Such a construction isolates the free end of the support member from the upper surface of the ski so as to avoid damage thereto.

Additional aspects of the invention will become apparent from the description thereof which appears in the following.

BRIEF DESCRIPTION OF THE DRAWINGS

The invention will be better understood when reference is had to the following drawings, in which like-numbers refer to like-parts, and in which:

FIG. 1, illustrates the heel tightening device of the invention in which the rear part of a safety ski binding is pivotally mounted on a ski 2. The Figure illustrates the locked mode of the binding, employed when the ski is to be transported. As shown, a turntable 5 is provided with shoulder members 7 (6), extending upwardly therefrom. The upper end of the shoulder members has arms 9 (8) pivotally mounted thereto. Between the arms is arranged a holding member 10, comprising a sole holder 11 associated with a closing pedal 12, the holding member being pivotal about a pivot axis 13.

Figure 1:
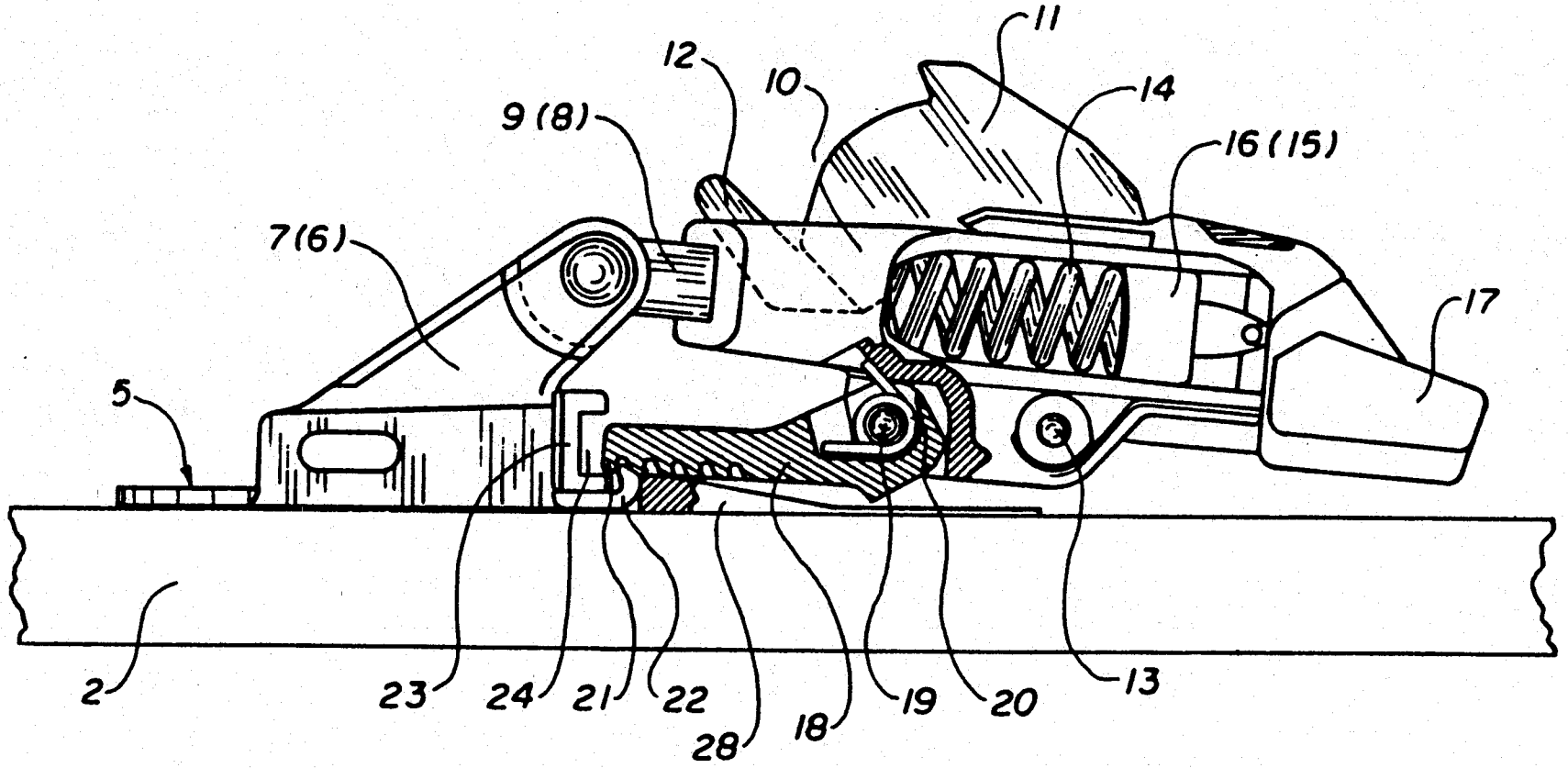
FIG. 1 is a partially sectioned, side elevation of a tightening device of the invention in its locked position, and in which the ski boot holding member is in its open position.

The arms 9 (8) constitute sliding guide means for the holding member 10, allowing the latter to slide along the arms to a limited extent in a longitudinal direction. Such sliding movement takes place against the force of two compression springs 14, which respectively bear against abutments 16 (15) mounted on the corresponding arms. The sole holder 11 is acted upon in a conventional manner by an actuating spring, not illustrated, accommodated in the holding member. When the sole holder is to be intentionally opened, rather than being automatically opened as the result of an external force acting on the binding, a release lever 17 which is pivotal coaxial to the sole holder in a bearing provided in the holding member 10, is activated.

Also seen in the Figure is the support member 18 on holding member 10, which is pivotally mounted on a pin 19 extending parallel to the pivot axis of arms 9 (8). The support part 18 is urged by a helical torsion spring 20 into a holding member support position, better seen in FIGS. 6 and 7. The support member 18, shown in FIG. 1 in its locked position, has a series of undercut slots which provide a hook feature 21 that cooperates with a projection 22, for example, on the turntable 5, to lock the support member in the binding's transport position.

Figure 2:
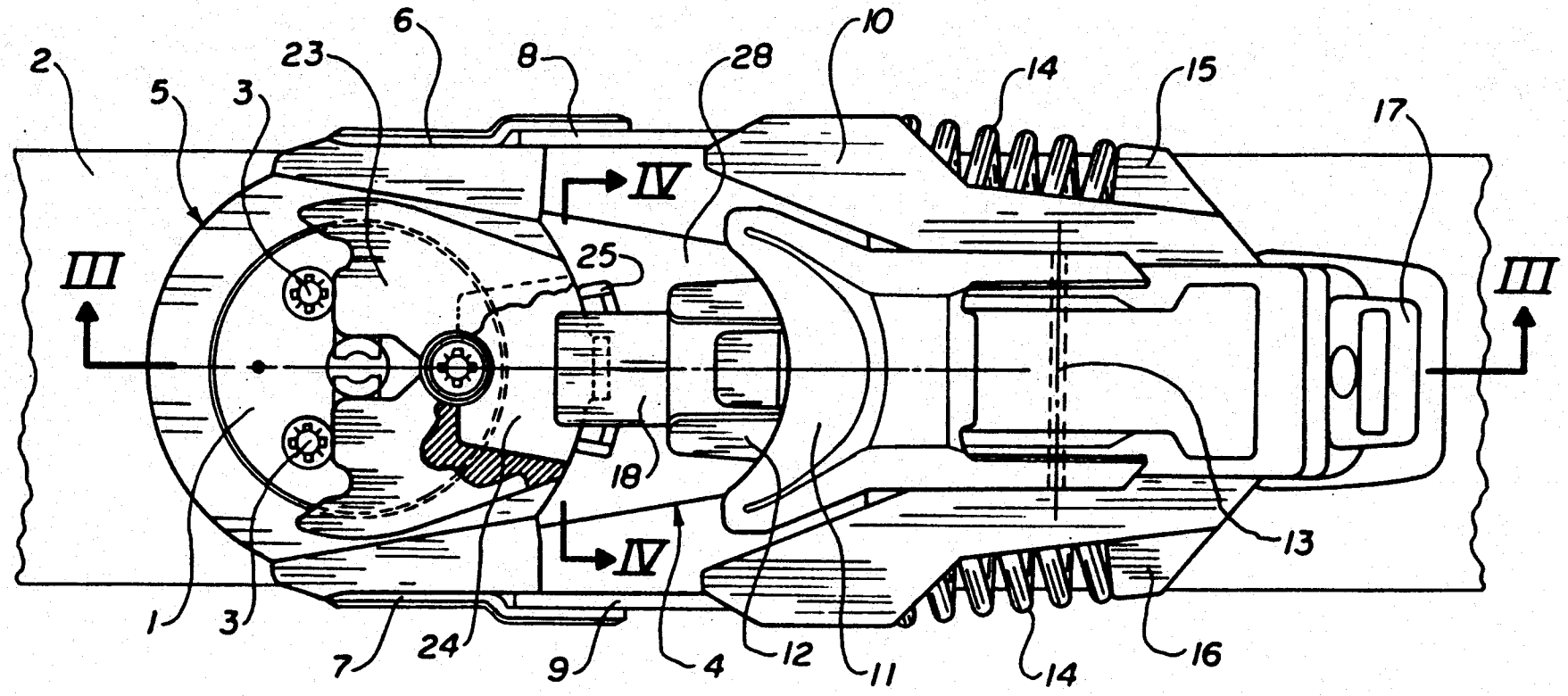
FIG. 2 is a partially sectioned, plan view of the tightening device of the invention as shown in FIG. 1.

FIG. 1 also shows a tread member 23, connected to bearing washer 1 shown in FIG. 2, which extends over a part of the turntable 5. It is on this tread element that the rear end of the sole of the ski boot is positioned and held during skiing. Recess 24 provides sufficient free space to accommodate the free end of the support member 18 when the binding is in its locked position.

The plurality of undercuts in the support member 18 allow the support member to be hooked at a number of locations, accommodating the different size ski boots which the binding can be adjusted to accept.

FIG. 2 is a partially sectioned, plan view of the tightening device of the invention of FIG. 1, showing the rear part of the safety ski binding pivotally fastened on ski 2 by means of a bearing washer 1. The bearing washer is connected to the ski by three screws 3, and is associated with an intermediate bearing plate 4 located beneath it, better seen in FIG. 3. The bearing washer 1, fastened by screws 3, anchors turntable 5 to the ski, the turntable being provided with upstanding shoulder members 6 and 7. The arms 8 and 9 are pivotally attached to shoulder members 6 and 7, respectively, and have compression springs 14 disposed on their ends, the springs bearing against abutments 15 and 16.

As illustrated, ski boot holding member 10, including sole holder 11 and closing pedal 12, is positioned between arms 8 and 9. Also shown in the Figure is support member 18, extending into recess 24 which lies adjacent to a support wall 25 with its associated unlocking ramps, more clearly illustrated in FIGS. 4 and 5.

Under conditions in which unacceptable forces are acting upon the binding, the toe portion of the binding, not shown, moves laterally to a release position, allowing the toe of the ski boot to move correspondingly. When this occurs, the heel of the ski boot also moves, being accommodated in such movement by the swiveling action of turntable 5, thereby avoiding the friction between the tread member 23 and the heel of the ski boot which would otherwise occur in the case of non-rotatable heel bindings. When release of the ski boot is desired in other circumstances, movement of the sole holder 11 and closing pedal 12 into a release position can be accomplished by activation of release lever 17.

Figure 3:
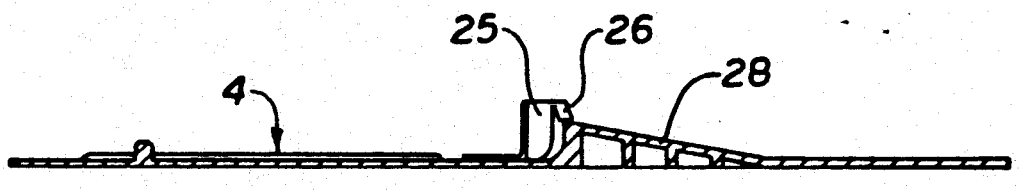
FIG. 3 is a section of a portion of the tightening device of FIG. 2 taken on the line III—III of that Figure, however, extending through only one bearing plate.

FIG. 3 is a section of a portion of the tightening device of FIG. 2, taken on the line III—III of FIG. 2. The Figure shows a bearing plate 4 provided with an upwardly extending support wall 25 which has unlocking ramps 26 connected thereto. The device of the invention has a bearing plate located between bearing washer 1 and the ski 2 which extends outwardly beneath turntable 5, facilitating rotation of the turntable relative to the ski.

A number of methods may be used for maintaining the turntable in its normal, neutral position on the ski, while permitting it to be temporarily displaced therefrom as when the binding assumes a release position as the result of external forces acting on the binding, or when it is desired to unlock the support member 18 from the turntable. Commonly, for example, a number of recesses are provided in the bearing washer and in the turntable. While not illustrated, these contain a helical compression spring which functions in a manner well known in the art as a locating or centering spring for the turntable. In the turntable's normal position, the recesses are flush with each other, the two ends of the centering springs bearing against the two discs, i.e., the washer and the turntable. However, upon pivoting, the turntable, and therefore the springs are tensioned by a force acting at one end of the springs, so that when the pivoting force is removed, the turntable returns to its normal, neutral position.

Figure 4:
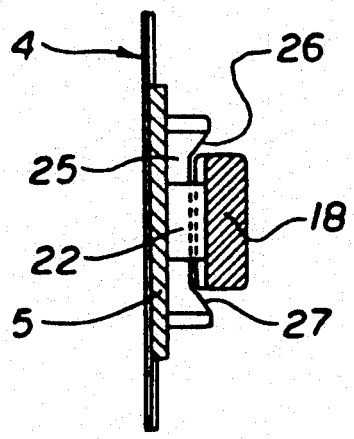
FIG. 4 is a section of the tightening device of FIG. 2 taken on the line IV—IV of that Figure.

FIG. 4 is a section of the tightening device of FIG. 2 taken on the line IV—IV of that Figure. Seen in the Figure is support member 18, positioned in the locked position of the device relative to projecting surface 22, the latter forming part of the turntable 5 mounted on bearing plate 4. Also illustrated is support wall 25, at the ends of which are respectively located unlocking ramps 26 and 27.

Figure 6:
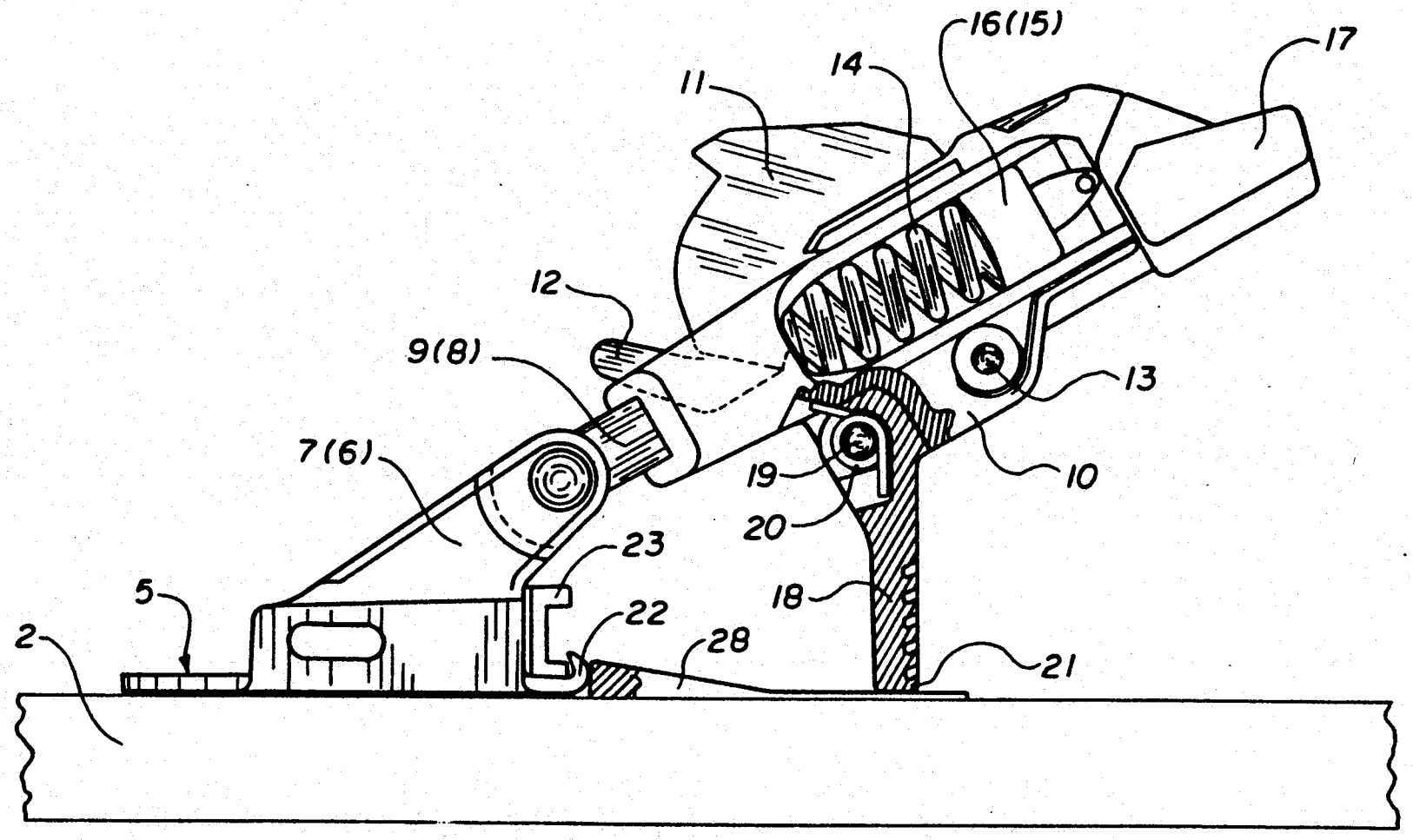
FIG. 6 is a partial section of the tightening device of the invention in an unlocked, supporting position, and in which the ski boot holding member is in its open position.

In order to lock the arms 8 and 9 and the holding member 10 therebetween in relation to the turntable 5 when the ski is not in use, the support member 18 is pivoted clockwise from the position shown for example in FIG. 6, against the force of the helical torsion spring 20 into the position illustrated in, for instance, FIG. 1. This is the position shown in FIG. 4 in which the hook 21 of the support member 18 fits over the projection 22 of the turntable 5, as also illustrated in FIG. 1. In this position, it is impossible for the holding member 10 to be moved into its closed position; such a movement only being possible when the support member 18 has been released from its locked position.

Figure 5:
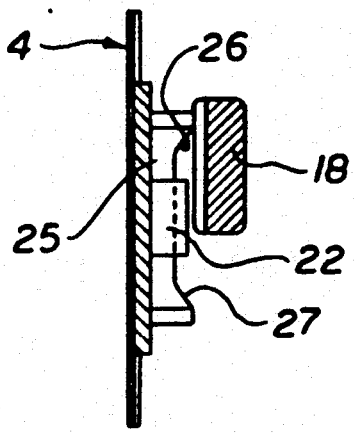
FIG. 5 is a section of the tightening device of FIG. 2 also taken on the line IV—IV, however, with the turntable rotated to dispose the support member lock in a release position.

FIG. 5 is a section of the tightening device of FIG. 2, also on the line IV—IV of FIG. 2, however, with the turntable having been rotated to move the support member lock into an unlocked position. Shown in the Figure is bearing plate 4, together with support member 18 disengaged from the hook-engaging, projecting surface 22. The Figure illustrates the situation in which release of the hook has been effected by pivoting the turntable 5 either upwards or downwards, in relation to the representation of FIG. 2, a distance no more than one third of the total pivot arc of the turntable. During such pivoting, the free end of the support member 18 has been raised by ramp 26 or 27, so that the hook 21 of the support member is disengaged from the projecting surface 22 of the turntable 5. Ramps 26 and 27 may form part of the bearing plate 4, or be positioned on each side of the projecting surface 22. After release, the supporting member 18 moves to its vertical, supporting position due to the action of the torsion spring 20, the heel tightening device assuming the position shown, for example, in FIG. 6.

FIG. 6 is a partial section of the tightening device of the invention in an unlocked position, and in which the ski boot holding member is in its open position.

Shown in the Figure is ski 2 on which is fastened turntable 5, as previously described. Connected to the turntable in an upright position are shoulder members 7 (6), pivotally connected to arms 9 (8). Such arms have positioned therebetween a ski boot holding member comprising sole holder 11, together with its associated closing pedal 12. Mounted on the arms are compression springs 14, which bear against abutments 16 (15). The ski boot holding member, which is shown in a position in which it is able to receive a ski boot inserted therein, also includes a release lever 17 by which a ski boot may be removed from the holding member if desired when the latter is in its locked position. The ski holding member 10, which pivots about axis 13, has a support member 18 pivotally attached thereto by a pivot pin 19. The support member 18, which is urged into its vertical supporting position by torsion spring 20, rests upon the radial lug 28 extending, for example, from the bearing plate 4, better viewed in FIG. 3. The Figure also shows the tread member 23 and the hook-engaging projecting surface 22, which may either form part of the turntable or of a bearing member.

As can be seen in FIG. 6, the heel binding device is supported in an elevated position by support member 18, with the ski boot holding member in its open position. The device so positioned accepts placement of the heel member of a ski boot on closing pedal 12, causing the sole holder to rotate about pivot point 13 into its closed position where the boot comes to rest upon tread member 23, the bottom of the support member 18 thereupon being spaced from its engagement with radial lug 28.

Figure 7:
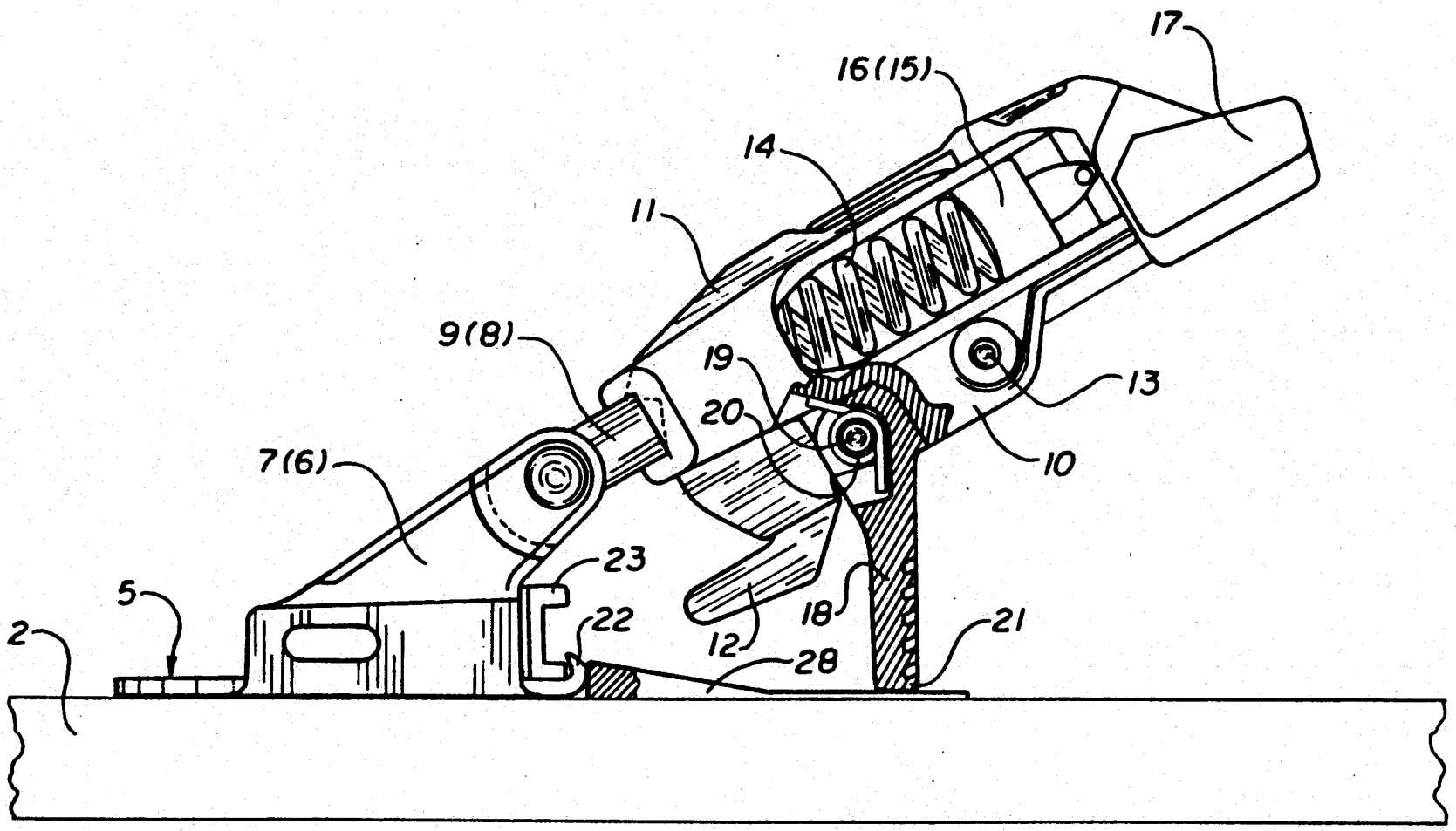
FIG. 7 is a view of the tightening device of FIG. 6, but in which the ski boot holding member is in its closed position.

FIG. 7 is a view of the tightening device of FIG. 6, but in which the ski boot holding member is in its closed position.

Again, the Figure shows a ski 2 on which turntable 5 is mounted with shoulder members 7 (6) located thereon. Arms 9 (8) with the boot sole holding member 10 positioned therebetween is shown with sole holder 11 and closing pedal 12 having been rotated about pivot axis 13 into a closed position. Since no ski boot is located in the binding, the binding rests upon support member 18, which is pivotally attached by pivot pin 19, being maintained in that position by torsion spring 20. Springs 14, located for bearing against abutments 16 (15) are also shown, as is binding release lever 17. FIG. 6 further discloses radial lug 28, adjacent to hook-engaging projecting surface 22 and tread member 23. While the Figure shows the bottom of support member 18 resting on radial lug 28, in those instances in which a ski boot is locked in the binding, the ski boot and therefore the skier's weight, rests on tread member 23, not on support member 18 which is then spaced from the lug.

While in accordance with the patent statutes, a preferred embodiment and best mode has been presented, the scope of the invention is not limited thereto, but is measured by the scope of the attached claims.

What is claimed is:

1. A lockable heel device for a safety binding of a ski comprising:
   - a turntable pivotal through an arc and provided with two shoulder members;
   - arm members attached to said shoulder members and supporting therebetween a ski boot holding member comprising a sole holder and a closing pedal;
   - a pivotal support member attached on one end to said holding member, and having a hook disposed on its unattached end; and
   - a hook-engaging, projecting surface;
   - wherein said support member is pivotable between a ski boot holding member supporting position where its unattached end bears on a bearing surface associated with said ski, and a locked position in which said hook is engaged with said projecting surface.

2. A device according to claim 1 in which said hook-engaging surface is connected to said turntable.

3. A device according to claim 1 in which said support member is associated with spring means that urge it into said supporting position.

4. A device according to claim 2 in which said projecting surface is associated with a hook-disengaging means which operates to disengage said hook when said turntable is rotated.

5. A device according to claim 4 in which said disengaging means comprises upwardly sloped ramps which act to disengage said hook from said projecting surface when said turntable is rotated.

6. A device according to claim 3 in which said hook becomes disengaged from said projecting surface when said turntable is rotated through no more than a distance of one-third of said pivot arc.

7. A device according to claim 1 in which said bearing surface comprises a bearing plate extending over an upper surface of said ski and located so that said unattached end bears thereupon when said support member is deployed in its holding member supporting position.

8. A device according to claim 1 and further comprising means for enabling pivoting of said sole holder and said closing pedal.

9. A lockable heel device for a safety binding of a ski comprising:

a turntable, pivotal through an arc, provided with two upstanding shoulder members and a hook-engaging, projecting surface;

rigid arm members pivotally attached to said shoulder members and supporting therebetween a ski boot holding member comprising a sole holder and a closing pedal;

a pivotal support member attached on one end to said holding member and having a hook disposed on its unattached end, said support member being associated with spring means that urge it into a vertical position, supporting said holding member; and release ramps adjacent said projecting surface, wherein said support member can be locked to said hook-engaging projecting surface by pivoting the support member from its holding member support position and engaging said hook with said projecting surface while the support member can be released from its locked position, allowing it to return to its holding member support position by rotating said turntable until said hook becomes disengaged from said projecting surface through its contact with said release ramps.

10. A ski with a binding according to claim 1 mounted thereon.

* * * * *